United States Patent [19]

Kirschnek et al.

[11] 4,121,898

[45] Oct. 24, 1978

[54] PROCESS FOR DYEING SYNTHETIC POLYAMIDE FIBRE MATERIALS

[75] Inventors: Helmut Kirschnek, Leverkusen; Karlhans Jakobs, Bergisch-Gladbach, both of Germany

[73] Assignee: Bayer Aktiengesellschaft, Leverkusen, Germany

[21] Appl. No.: 818,599

[22] Filed: Jul. 25, 1977

[30] Foreign Application Priority Data

Jul. 27, 1976 [DE] Fed. Rep. of Germany ..... 2633615

[51] Int. Cl.[2] ..... D06P 1/39; D06P 1/645; D06P 5/06

[52] U.S. Cl. ..... 8/25; 8/26; 8/169; 8/88; 8/DIG. 21

[58] Field of Search ..... 8/88, 169, 25, 26

[56] References Cited

U.S. PATENT DOCUMENTS

| | | | |
|---|---|---|---|
| 2,963,513 | 12/1960 | Albrecht | 8/88 |
| 3,086,832 | 4/1963 | Casty | 8/88 |
| 3,104,931 | 9/1963 | Casty et al. | 8/88 |
| 3,218,116 | 11/1965 | Casty et al. | 8/88 |
| 3,529,922 | 9/1970 | Berger et al. | 8/84 |
| 3,957,425 | 5/1976 | Tuillo | 8/88 |

FOREIGN PATENT DOCUMENTS

| | | | |
|---|---|---|---|
| 2,360,632 | 7/1974 | Fed. Rep. of Germany | 8/169 |
| 1,469,737 | 1/1969 | Fed. Rep. of Germany | 8/169 |
| 1,378,695 | 10/1964 | France | 8/84 |

OTHER PUBLICATIONS

Schmidlin, H. U., *Preparation and Dyeing of Synthetic Fibers*, Chapman & Hall, London, 1963.

American Dyestuff Reporter, Feb. 19, 1951, Douglas, G. T.

Du Pont Fibers Bulletin, N-259, Sep. 1972.

*Primary Examiner*—Joseph L. Schoter
*Assistant Examiner*—Maria S. Tungol
*Attorney, Agent, or Firm*—Plumley and Tyner

[57] ABSTRACT

In a process for dyeing synthetic polyamide fibre materials with metal-free acid dyestuffs a dye liquor is used which contains compounds of the formula

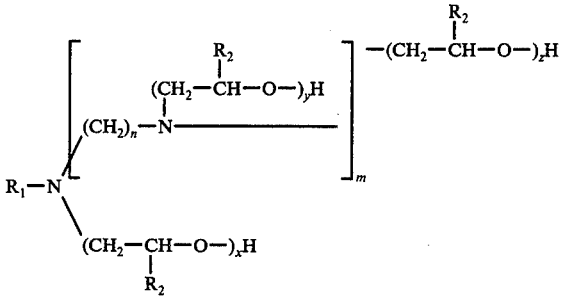

wherein $R_1$ represents an alkyl and/or alkenyl radical with 12–22 carbon atoms, $R_2$ represents hydrogen and/or methyl, $m$ represents 0 or 1, $n$ represents 2 or 3 and the sum of $x + y + z$ represents a number from 10–30, and compounds of the formula $R_3 - B - X$ wherein $R_3$ represents an alkyl radical with 12–22 carbon atoms and/or a phenyl or/and naphthyl radical which contains a total of 12–22 carbon atoms and is substituted by one or more alkyl radicals, B represents —O—$SO_2$— and/or —$SO_3$ and X represents hydrogen or an ammonium, alkali metal, alkaline earth metal, mono-, di- or tri-alkylammonium or hydroxyalkylammonium ion with, in each case, 1–4 carbon atoms in the alkyl radical, or represents a cyclohexyl-ammonium ion.

6 Claims, No Drawings

PROCESS FOR DYEING SYNTHETIC POLYAMIDE FIBRE MATERIALS

The invention relates to a process for dyeing synthetic polyamide fibre materials with metal-free acid dyestuffs.

The process is characterised in that a dye liquor which contains compounds of the formula

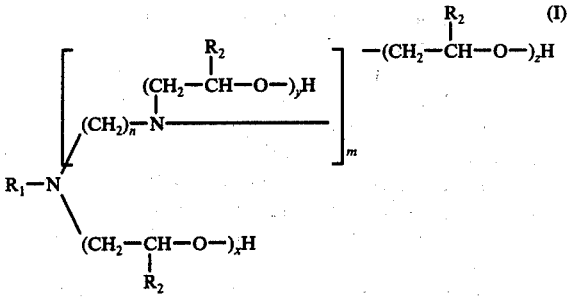

(I)

wherein $R_1$ represents an alkyl and/or alkenyl radical with 12–22 carbon atoms, $R_2$ represents hydrogen and/or methyl, $m$ represents 0 or 1, $n$ represents 2 or 3 and the sum of $x + y + z$ represents a number from 10–30, and compounds of the formula $$R_3 - B - X \qquad \text{(II)}$$

wherein $R_3$ represents an alkyl radical with 12–22 carbon atoms and/or a phenyl or/and naphthyl radical which contains a total of 12–22 carbon atoms and is substituted by one or more alkyl radicals, B represents $-O-SO_2-$ and/or $-SO_3$ and X represents hydrogen or an ammonium, alkali metal, alkaline earth metal, mono-, di- or tri-alkylammonium or hydroxyalkylammonium ion with, in each case, 1–4 carbon atoms in the alkyl radical, or represents a cyclohexyl-ammonium ion, is used.

The non-oxalkylated amines on which the cationic compounds of the formula I are based are preferably derived from natural fatty acids and are fully biodegradable.

Examples of such amines which may be mentioned are: dodecylamine, tetradecylamine, hexadecylamine, octadecylamine, eicosylamine and docosylamine and also the amine of the formula $[CH_3-(CH_2)_7-CH_2-]_2 = CH-NH_2$ as well as palmitooleylamine, oleylamine, linolylamine, linolenylamine, eicosenylamine and docosenylamine and mixtures thereof.

When the formula I is based on an alkyl-alkylenediamine, the latter is, for example, a N-octadecyl-propylene-1,3-diamine or a N-oleyl-ethylene-1,2-diamine. Preferred suitable amines are those which are derived from technical tallow fatty acids, that is to say which consist mainly of mixtures of palmitylamine, stearylamine, oleylamine and linolylamine.

The oxalkylation products of the formula I are obtained in a known manner by alkoxylation of the monoamines or diamines with ethylene oxide ($R_2 = H$) and/or propylene oxide ($R_2 = CH_3$) and, in order to achieve an adequate solubility in water, the proportion of ethylene oxide is greater than that of propylene oxide. Thus, the amines can be reacted either only with ethylene oxide or, for example, first with propylene oxide and then with ethylene oxide.

The compounds of the formula I are described, for example, in the patent specifications which are mentioned in N. Schonfeld "Surface Active Ethylene Oxide Adducts" (1969), page 95–99.

The number of alkylene oxide units per mol of starting amine depends on the nature of the amine and must be determined by preliminary experiments for each particular case. Preferably, 12–22 mols of alkylene oxide act on 1 mol of monoamine or diamine.

Preferred compounds of the formula I are those of the formulae

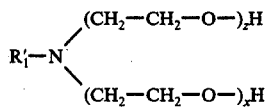

(III)

in which $Z + X = 10–20$ and $R'_1 = C_{12}–C_{18}$-alkyl or -alkenyl, and

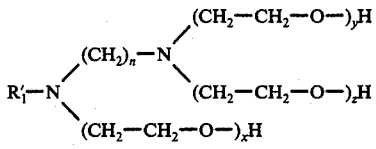

(IV)

in which $X + Y + Z = 10–20$, $R'_1 = C_{12}–C_{18}$-alkyl or -alkenyl and $n = 2$ or 3.

The following compounds may be mentioned as examples:

$[CH_3-(CH_2)_7-CH_2]_2>CH-N<[(CH_2-CH_2-O-)_{10}H]_2$ $[CH_3-(CH_2)_7-CH_2]_2>CH-N(CH_2-CH_2-O-)_6H-CH_2-CH_2-CH_2-N<[(CH_2-CH_2-O-)_6H]_2$ $CH_3-(CH_2)_{16}-CH_2-N(CH_2-CH_2-O-)_4H-CH_2-CH_2-CH_2-N<[(CH_2-CH_2-O-)_4H]_2$ $CH_3-(CH_2)_7-CH=CH-(CH_2)_7-CH_2-N<[CH_2-CH(CH_3)-O-(CH_2-CH_2-O-)_{10}H]_2$ and $$CH_3-(CH_2)_7-CH=CH-(CH_2)_7-CH_2-N<[(CH_2-CH_2-O-)_{5.5}H]_2$$

Examples which may be mentioned for the radical $R_3$ in the anionic compounds II are: the dodecyl, tridecyl, tetradecyl, pentadecyl, hexadecyl, octadecyl, eicosyl, docosyl, oleyl, linoyl, linolenyl and docosenyl radical and also the tetradecylbenzene, dodecylbenzene, nonylbenzene and di-n-butyl-naphthalene radical.

The phenyl or naphthyl radical which represents $R_3$ can be substituted by 1–3 alkyl groups.

Preferred anionic compounds of the formula II are those of the formula

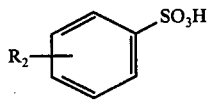

(V)

wherein $R_2$ represents an unsubstituted alkyl radical with 10–14 C atoms.

The following compounds may be mentioned as examples: dodecylsulphonic acid, tetradecylsulphonic acid, octadecyl-sulphonic acid, eicosylsulphonic acid and the technical mixtures of paraffinsulphonic acids obtainable from $C_{12}$–$C_{22}$-kogasin by sulphochlorination or sulphoxidation, and also the monosulphuric acid esters of lauryl alcohol, cetyl alcohol, stearyl alcohol, behenyl alcohol, oleyl alcohol and linolyl alcohol, and also tetradecylbenzenesulphonic acid, dodecylbenzenesulphonic acid, nonylbenzenesulphonic acid and di-n-butyl-naphthalene-sulphonic acid, as well as the salts of the above acids with ammonia, sodium, potassium, magnesium, calcium, ethylamine, propylamine, butylamine, diethylamine, dipropylamine, diisopropylamine, monoethanolamine, diethanolamine, triethanolamine and cyclohexylamine.

The components of the formulae I and II are added to the dye liquor in a molar ratio of, in general, 0.6:1 to 1:0.6, and preferably of 0.8:1 to 1:0.8, in a total amount of, in particular, 0.1 to 5 parts per 1,000 parts of dye liquor. This corresponds approximately to an amount of 0.4–3%, relative to the goods to be dyed.

The amounts which have an optimum effect can easily be determined by preliminary experiments, in accordance with the pH value.

The synthetic polymide fibre materials are preferably dyed by the exhaustion process. For this purpose, the goods to be dyed are introduced into an aqueous liquor which has been warmed to about 40° C. and contains the products of the formula I and II, to be used according to the invention, and one or more dyestuffs and the pH of which has been adjusted to about 4.5–6 with acetic acid. The temperature of the dye-bath is then raised to approximately 100° C. in the course of about 30 minutes and the dyebath is then left at this temperature until it is largely exhausted. However, it is also possible to add the dyestuff to the dyebath only subsequently, for example when the temperature of the bath has risen to about 60° C.

The acid dyestuffs to be used in the process according to the invention can belong to very diverse categories of dye-stuff, for example to the category of azo dyestuffs, anthraquinone dyestuffs or triphenylmethane dyestuffs. Metal-free acid dyestuffs containing a sulphonic acid group are preferably used.

Examples of dyestuffs which may be mentioned are: C.I. Acid Yellow 49, C.I. Acid Yellow 197, C.I. Acid Red 337, C.I. Acid Blue 40, C.I. Acid Blue 62, C.I. Acid Brown 248, C.I. Acid Yellow 135, C.I. Acid Red 266, C.I. Acid Blue 25, C.I. Acid Orange 116, C.I. Acid Red 299 and C.I. Acid Blue 264.

These designations relate to the data given in the Colour Index, 3rd edition (1971), volume 1.

The invention also relates to agents, in the presence of which the process according to the invention is carried out. The agents contain the compounds of the formulae I and II and can optionally contain further auxiliaries customary in dyeing, such as softeners, wetting agents, antistatic agents, levelling agents or compounds for adjusting the pH to the desired value, such as sodium hydroxide solution, acetic acid, sodium acetate, monosodium phosphate or disodium phosphate and, in particular, water.

The agents contain the compounds I and II in, for example, a molar ratio of 0.6:1 to 1:0.6 and preferably of 0.8:1 to 1:0.8.

With the aid of the process according to the invention it is possible to obtain dyeings on synthetic polyamide fibre materials of very diverse types, such as filaments, woven fabrics and knitted fabrics, which are produced, for example, from ε-caprolactam, hexamethylenediamine adipate or from ω-aminoundecanoic acid and these dyeings are distinguished by high levelness, uniform penetration of the fibres, good fastness properties and, above all, by a reduced drain effect.

The new process can be used particularly advantageously for combination dyeings with several metal-free acid dyestuffs. In this case, an approximate equalisation of the different rates of absorption of the individual dyestuffs is achieved.

In combination dyeings, the different affinities of the individual acid dyestuffs for the polyamide fibre materials lead to high degrees of unlevelness, unreproducible colour shades and deficient fastness properties. Moreover, the absorption characteristics are influenced by the particular mixing ratio of the dyestuffs to be combined.

Dyebath formulations which have an affinity for the fibre do not provide a remedy in this case. On the other hand, it is known to those skilled in the art that auxiliaries which have an affinity for the dyestuff tend to form dyestuff/auxiliary adducts which prevent fixing of the dyestuff to the fibre and, inter alia, must be regarded as a cause of the drain effect.

It has surprisingly been found that, in the case of combination dyeings, an approximate equalisation of the absorption curve for the individual acid dyestuffs is achieved during the total temperature programme, independently of the particular bath temperature and independently of the particular quantity ratio, that is to say a solid shade absorption is achieved, and the drain effect is greatly reduced, with the aid of the new process.

The parts indicated are parts by weight.

EXAMPLE 1

Using a liquor ratio of 1:15, a knitted fabric which consists of polyhexamethylenediamine adipate filaments is introduced into a bath which contains, per liter, 0.8 g of an acid dyestuff of the formula

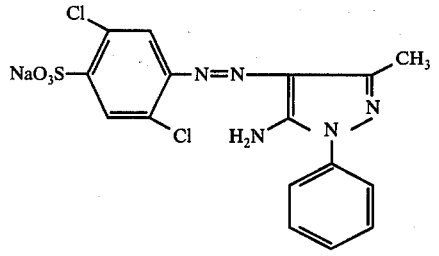

1 g of an acid dyestuff of the formula

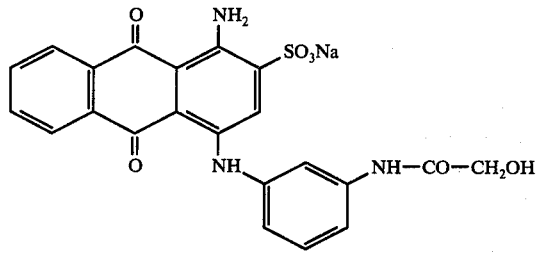

and 0.52 g of a mixture of 77 parts of stearylaminopolyglycol ether (20 mols of ethylene oxide) and 23 parts of dodecylbenzenesulphonic acid (molar ratio of the cationic compound to the anionic compound, 1:1.06) and the pH of which has been adjusted to 5 with acetic acid.

Dyeing is started at 40° C., the temperature of the bath is gradually raised to 98° and dyeing is carried out for 1 hour at this temperature. It is found that the two dyestuffs are taken up by the fibre material at the same time. A completely uniform green dyeing is obtained.

An equally good result is obtained when (a) 0.52 g of a mixture of 76.7 parts of a compound of the formula $$CH_3-(CH_2)_{10-18}-CH_2-N<[(CH_2-CH_2-O-)_6H]_2$$

and 23.3 parts of a compound of the formula $$CH_3-(CH_2)_{12-16}-CH_2-SO_3H$$

(molar ratio of the cationic compound to the anionic compound, 1:0.8), or (b) 0.52 g of a mixture of 79.5 parts of a compound of the formula $$[CH_3-(CH_2)_7-CH_2-]_2>CH-N<[(CH_2-CH_2-O-)_{10}H]_2$$

9.3 parts of n-dibutyl-naphthalenesulphonic acid, 9.3 parts of dodecylbenzenesulphonic acid and 1.9 parts of sodium hydroxide (molar ratio of the cationic component to the anionic component to NaOH, 0.8:1:0.5) is used in place of the mixture of stearyl-aminopolyglycol ether and dodecylbenzenesulphonic acid.

EXAMPLE 2

Using a liquor ratio of 1:10, a staple fibre yarn of polymeric ε-caprolactam is introduced, in the form of a muff, into a dyebath which contains, per liter, 1.5 g of the acid dyestuff C.I. No. 17,070 (Colour Index, 3rd edition (1971), volume 4) and 0.5 g of a mixture of 64.6 parts by weight of the compound of the formula $$C_{18}H_{37}-N(CH_2-CH_2-O-)_xH-CH_2-CH_2-CH_2-N(CH_2-CH_2-O-)_yH-(CH_2-CH_2-O-)_zH \qquad x+y+z=15$$

21.4 parts by weight of dodecylbenzenesulphonic acid, 0.4 part of sodium hydroxide (molar ratio of the cationic component to the anionic component to NaOH, 1:1:0.16) and 13.6 parts of water and the pH of which has been adjusted to 4.5 with acetic acid. Dyeing is started at 40°. The temperature of the bath is then gradually raised to 98° and the bath is kept at this temperature for about 1½ hours. A completely uniform red dyeing is obtained. The dyebath is exhausted after a dyeing time of 1½ hours. The dyeing is fast and does not bleed during cooling.

An equally good result is obtained when a) 0.43 g of a mixture of 77.7 parts of a compound of the formula $$[CH_3-(CH_2)_7-CH_2]_2>CH-N(CH_2-CH_2-O-)_6H-CH_2-CH_2-CH_2-N<[(CH_2-CH_2-O-)_6H]_2$$

and 22.3 parts of dodecylbenzenesulphonic acid (molar ratio of the cationic component to the anionic component, 1:1), (b) 0.45 g of a mixture of 70 parts of a compound of the formula $$CH_3-(CH_2)_{10-18}-CH_2-N(CH_2-CH_2-O-)_4H-CH_2-CH_2-N<[(CH_2-CH_2-O-)_4H]_2$$

14,7 parts of tetradecylsulphonic acid, 14.8 parts of dodecylbenzenesulphonic acid and 0.5 part of sodium hydroxide (molar ratio of the cationic component to the anionic component to NaOH, 0.9:1:0.25), or (c) 0.45 g of a mixture if 75 parts of a compound of the formula $$(CH_3-(CH_2)_7-CH=CH-(CH_2)_7-CH_2-N(CH_2-CH_2-O-)_5H-CH_2-CH_2-CH_2-N<[(CH_2-CH_2-O-)_5H]_2$$

and 25 parts of dodecylbenzenesulphonic acid (molar ratio of the cationic component to the anionic component, 1:1) is used in place of the mixture mentioned.

If the acid dyestuffs C.I. No. 62,045, 62,055 or 62,125 (Colour Index, 3rd edition, (1971), volume 4) are used in place of the dyestuff, uniform blue dyeings with good fastness properties are obtained.

The blue dyestuffs mentioned can also be used together with the first dyestuff of Example 1. In that case uniform green dyeings are obtained.

EXAMPLE 3

Using a liquor ratio of 1:20, a fabric made of fibres produced from ε-aminocaprolactam is introduced into a dyebath which contains, per liter, 0.2 g of the first dyestuff from Example 1, 0.6 g of the second dyestuff from Example 1 and 0.22 g of the acid dyestuff C.I. No. 17,070 (Colour Index, 3rd edition (1971), volume 4). The dye liquor also contains 0.2 g of a mixture of 64.6 parts of stearylaminopolyglycol ether (20 mols of ethylene oxide), 19.0 parts of dodecylbenzenesulphonate and 16.4 parts of water and its pH has been adjusted to 5 with acetic acid. Dyeing is started at 40°, the temperature of the bath is gradually raised to 98° and dyeing is carried out for 1½ hours at this temperature. The three dyestuffs mentioned are taken up by the fibre at the same time. A uniform grey dyeing, which does not bleed when the dyebath is cooled, is obtained. The fabric displays good penetration of the individual filaments.

An equally good result is obtained when (a) 0.2 g of a mixture of 71.7 parts of a compound of the formula $$CH_3-(CH_2)_7-CH=CH-(CH_2)_7-CH_2-N<[(CH_2-CH_2-O-)_{5,5}H]_2$$

and 28.3 parts of dodecylbenzenesulphonic acid (molar ratio of the cationic component to the anionic component 1:0.9), (b) 0.2 g of a mixture of 74.3 parts of a compound of the formula $$CH_3-(CH_2)_7-CH=CH-(CH_2)_7-CH_2-N<[CH_2-\overset{CH_3}{\overset{|}{C}}H-O-(CH_2-CH_2-O-)_{10}H]_2$$

12.2 parts of dodecylbenzenesulphonic acid and 13.5 parts of the Na salt of the oleyl alcohol monoester of sulphuric acid (molar ratio of the cationic component to the anionic component, 0.8:1), (c) 0.26 g of a mixture of 77.3 parts of a compound of the formula $$CH_3-(CH_2)_4-CH=CH-CH_2-CH=CH-(CH_2)_7-CH_2-N<[CH_3-\overset{CH_3}{\overset{|}{C}}H-O-(CH_2-CH_2-O-)_{14}H]_2$$

and 22.7 parts of dodecylbenzenesulphonic acid (molar ratio of the cationic component to the anionic component, 0.65:1), or d) 0.2 g of a mixture of 88 parts of a compound of the formula $$[CH_3-(CH_2)_7-CH_2]_2>CH-N<[(CH_2-\overset{CH_3}{\overset{|}{C}}H-O-)_2-(CH_2-CH_2-O-)_{12}H]_2$$

and 12 parts of dodecylbenzenesulphonic acid (molar ratio of the cationic component to the anionic component, 1:0.65) is used in place of the mixture of stearylaminopolyglycol ether and dodecylbenzenesulphonic acid.

We claim:

1. Process for producing uniform, level dyeings of increased fastness and reduced drain effect in the dyeing of synthetic polyamide fibre materials with two or more metal-free acid dyestuffs which have different rates of absorption into said polyamide fiber material comprising dyeing said polyamide materials in an aqueous dye liquor consisting essentially of water, said metal-free acid dyestuffs, a cationic compound of the formula:

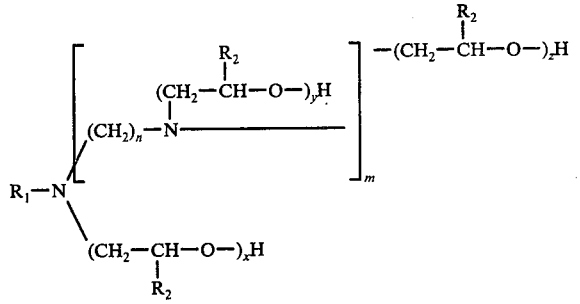

wherein $R_1$ represents alkyl or alkenyl with 12–22 carbon atoms;

$R_2$ represents hydrogen or methyl;

$m$ represents 0 or 1;

$n$ represents 2 or 3; and the sum of $x + y + z$ represents a number from 10–30; and an anionic compound of the formula:

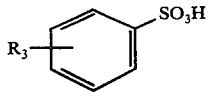

wherein $R_3$ represents an substituted alkyl radical with 10–14 C atoms;

said cationic and anionic compounds being present in the dye liquor in a molar ratio of 0.6:1 to 1:0.6.

2. The process of claim 1, wherein the polyamide materials are dyed for at least about 1 hour at a temperature of about 100° C.

3. Process according to claim 1, characterized in that dye liquors which contain the cationic compounds and anionic compounds in a total amount of 0.1–5 parts per 1,000 parts of dye liquor are used.

4. Process according to claim 1, wherein the cationic component employed is a compound of the formula $$[CH_3-(CH_2)_7-CH_2]_2>CH-N<[(CH_2-CH_2-O-)_{10}H]_2$$

5. Process according to claim 1, wherein the cationic component employed is a compound of the formula $$[CH_3-(CH_2)_7-CH_2]_2>CH-\underset{\underset{(CH_2-CH_2-O-)_6H}{|}}{N}-CH_2-CH_2-CH_2-N<[(CH_2-CH_2-O-)_6H]_2$$

6. Process according to claim 1, wherein the cationic component employed is a compound of the formula $$CH_3-(CH_2)_7-CH=CH-(CH_2)_7-CH_2-N<[(CH_2-CH_2-O-)_{5,5}H]_2$$

and the sodium salt of dodecylbenzenesulphonic acid in a molar ratio of 1:0.9.

* * * * *